US007685852B2

(12) United States Patent
Komemi

(10) Patent No.: US 7,685,852 B2
(45) Date of Patent: Mar. 30, 2010

(54) TOOL FOR PIN TUMBLER LOCKS

(76) Inventor: Rahamim Komemi, 9 Moshav, Aminadav (IL) 90885

( * ) Notice: Subject to any disclaimer, the term of this patent is extended or adjusted under 35 U.S.C. 154(b) by 291 days.

(21) Appl. No.: 11/823,684

(22) Filed: Jun. 28, 2007

(65) Prior Publication Data

US 2009/0000113 A1 Jan. 1, 2009

(51) Int. Cl.
*E05B 9/04* (2006.01)

(52) U.S. Cl. ..... 70/375; 70/394; 70/368; 81/15.9; 29/464; 29/804

(58) Field of Classification Search ..... 70/375, 70/378, 367, 368, 493, 466, DIG. 5; 29/464, 29/804, 281.1, 271, 272, 434, 436, 468, 225, 29/253; 81/15.9, 3.55, 3.57, 3.36, 367, 375
See application file for complete search history.

(56) References Cited

U.S. PATENT DOCUMENTS

| | | | | |
|---|---|---|---|---|
| 8,071 | A | | 5/1851 | Yale, Jr. |
| 9,850 | A | | 7/1853 | Yale, Jr. |
| 31,278 | A | | 1/1861 | Yale, Jr. |
| 271,962 | A | | 2/1883 | White |
| 422,013 | A | | 2/1890 | Ekstrom |
| 952,787 | A | | 3/1910 | Crawford |
| 988,663 | A | | 4/1911 | Rees |
| 1,004,904 | A | | 10/1911 | Rees |
| 1,113,193 | A | | 10/1914 | Carroll |
| 1,135,027 | A | | 4/1915 | Kohlberger |
| 1,156,764 | A | | 10/1915 | Druck |
| 1,200,430 | A | | 10/1916 | Rosenstein |
| 1,437,832 | A | * | 12/1922 | Bradley, Jr. ..... 29/464 |
| 1,438,391 | A | | 12/1922 | Nutter |
| 1,513,718 | A | | 10/1924 | Morehouse |
| 1,531,567 | A | | 3/1925 | Niblock |
| 1,596,678 | A | | 8/1926 | Miller |
| 1,679,759 | A | * | 8/1928 | Best ..... 29/564.1 |
| 1,937,165 | A | | 11/1933 | Piagneri |
| 2,105,659 | A | | 1/1938 | Jacobi |
| 2,774,133 | A | | 12/1956 | Sitz |
| 2,887,918 | A | | 5/1959 | Benson |
| 3,002,268 | A | | 10/1961 | Spain |

(Continued)

FOREIGN PATENT DOCUMENTS

| | | |
|---|---|---|
| CA | 2344569 | 10/2002 |

(Continued)

*Primary Examiner*—Suzanne D Barrett
(74) *Attorney, Agent, or Firm*—Iandiorio Teska & Coleman

(57) ABSTRACT

A tool for loading pin stack elements into a pin tumbler lock includes a cylindrical shank of diameter similar to the diameter of the lock plug, a loading groove extending along at least a shank portion corresponding to the length of the set of pin chambers and intersecting with the shank axis; a set of parallel loading bores formed in the shank, extending between the loading groove and the outer surface of the shank, each loading bore dimensioned to contain pin stack elements, the loading bores further having a spacing along the shank in a direction parallel to its axis equal to the spacing of the chambers; and a loader element mounted within the loading groove in adjustable positioning with respect to the loading bores, operative for selectable transfer of a pin stack element from each loading bore to a chamber in axial registration therewith.

18 Claims, 11 Drawing Sheets

U.S. PATENT DOCUMENTS

| | | | | | |
|---|---|---|---|---|---|
| 3,111,748 | A | | 11/1963 | Doll et al. | |
| 3,183,692 | A | | 5/1965 | Check | |
| 3,218,699 | A | | 11/1965 | Maese | |
| 3,417,452 | A | | 12/1968 | Roland | |
| 3,664,007 | A | | 5/1972 | Schlage | |
| 3,816,899 | A | | 6/1974 | Kitts | |
| 4,059,883 | A | | 11/1977 | Osborne | |
| 4,142,391 | A | | 3/1979 | Paig | |
| 4,305,314 | A | | 12/1981 | Simpson | |
| 4,667,494 | A | * | 5/1987 | Joosten | 70/394 |
| 4,675,994 | A | | 6/1987 | Detloff | |
| 4,680,860 | A | | 7/1987 | Detloff | |
| 4,732,023 | A | | 3/1988 | Shen | |
| 4,741,188 | A | | 5/1988 | Smith | |
| 4,747,281 | A | | 5/1988 | Monahan | |
| 4,763,395 | A | | 8/1988 | Fontaine | |
| 4,836,002 | A | | 6/1989 | Monahan | |
| D302,647 | S | * | 8/1989 | Powell, III | D8/71 |
| 5,450,662 | A | | 9/1995 | Watts | |
| 5,609,052 | A | * | 3/1997 | Denning | 70/368 |
| 5,628,109 | A | | 5/1997 | Neuman | |
| 5,688,085 | A | | 11/1997 | Watts | |
| 5,964,111 | A | | 10/1999 | Lambert | |
| 5,966,973 | A | | 10/1999 | Watts | |
| 6,021,655 | A | | 2/2000 | Labbe et al. | |
| 6,052,883 | A | | 4/2000 | Kimzey | |

FOREIGN PATENT DOCUMENTS

| | | |
|---|---|---|
| DE | 816803 | 11/1951 |
| SU | 996704 | 2/1983 |
| WO | WO 2004101917 | 11/2004 |

* cited by examiner

TOOL FOR PIN TUMBLER LOCKS

FIELD OF THE INVENTION

The present invention relates to the reloading and recoding of pin tumbler locks.

BACKGROUND OF THE INVENTION

Pin tumbler locks have been known for many years, and are one of the most common types of locks employed.

Referring now to FIG. 1A, there is shown a fully assembled pin tumbler lock, referenced 10, as known in the art. Lock 10 includes a shell 11 having formed therein central cylindrical opening 12, also referred to herein merely as the "cylinder," in which is located a plug 13. Shell 11 further has formed therein a set of chambers 14, each of which is a radially extending bore adapted to receive therein a pin stack which includes first, second and third pin stack elements, respectively referenced 16, 17 and. 19. First pin stack element 16 is a compression spring, second pin stack element 17 is a driver pin, and third pin stack element 19 is a key pin.

As seen, the key pin 19 is outermost, and is supported on the driver pin 17, which is seated in turn on the compression spring 16, which assists in forcing the key pin 19 across a shear line (not shown) and into the keyway formed in the plug 13, so as to block rotation thereof within the cylinder 12. In this position, the lock cannot be opened without a key. As known, the driver pins are of uniform length, while the key pins are of different lengths.

Throughout the present specification and claims, unless specified otherwise, the term "pin stack element" is employed to mean any of the pin stack elements.

When a pin tumbler lock malfunctions, the plug and pin stacks must be removed so that all faulty elements of the pin stacks can be replaced. The position of the chambers relative to the opening of the shell requires special tools in order to be able to properly position the renewed pin stacks within their chambers, due partially to the fact that the chambers are radial to the cylindrical opening within the shell, and must be fully inserted—including the springs which tend to force the pins across the shear line—in order to facilitate insertion of the plug.

A further requirement with regard to the maintenance of pin tumbler locks concerns the need to 'recode' the locks from time to time by replacing the key pins. This is a time consuming and sometimes complicated process, and it is often more convenient simply to replace the entire lock mechanism. Clearly this is wasteful, and it would thus be desirable to be able to recode a pin tumbler lock quickly and simply.

There exist various tools and devices for reloading locks, and the following is a list of publications representative of the art:

U.S. Pat. No. 3,217,699 to Maese, entitled Method and Means for Assembling Lock Tumblers and Springs in Lock Cylinders and Plugs; U.S. Pat. No. 3,664,007 to Schlage, entitled Cylinder Loading Tool; U.S. Pat. No. 4,675,994 to Detloff, entitled Locksmith's Tool for Installing Spring and Driver Pins into Pin Tumbler Locks; U.S. Pat. No. 5,628,109 to Neuman, entitled Lock Cylinder Maintenance Tool; and U.S. Pat. No. 6,021,655 to Labbe et al, entitled Interchangeable Core Lock Repinning Apparatus.

SUMMARY OF THE INVENTION

The present invention seeks to provide a tool which may be used both for the reloading and the recoding of pin tumbler locks, in a rapid and convenient manner.

There is thus provided, in accordance with a preferred embodiment of the present invention, a tool for loading one or more pin stack elements into a pin tumbler lock having a shell in which is formed a cylindrical bore adapted to receive a plug, the shell further having formed therein a set of chambers for containing a pin stack having one or more pin stack elements, wherein the tool includes:

a cylindrical shank having a diameter similar to the diameter of the plug, and having formed therein a loading groove extending along at least a portion of the shank corresponding to the length of the set of chambers and intersecting with the longitudinal axis of the shank;

a set of parallel loading bores formed in the shank, extending between the loading groove and the cylindrical outer surface of the shank, each loading bore dimensioned to contain one or more elements of a pin stack, the loading bores further having a spacing along the shank in a direction parallel to the longitudinal axis thereof equal to the spacing of the chambers; and a loader element mounted within the loading groove in adjustable positioning with respect to the loading bores, operative for selectable transfer of a pin stack element from each loading bore to a chamber in axial registration therewith.

Additionally in accordance with a preferred embodiment of the present invention, the longitudinal loading groove has a width whose magnitude is less than the diameter of each loading bore, the loading groove intersecting with the loading bores along their entire depth.

Further in accordance with a preferred embodiment of the present invention, the loader element is a hinged element.

Additionally in accordance with a preferred embodiment of the present invention, each loading bore has an inner end formed within the shank, and an outer end at which is defined an opening at the outer cylindrical surface of the shank through which the a pin stack element is inserted prior to insertion of the shank into the cylindrical bore of the shell, and wherein the loader element is adjustable between a retracted position and an extended position.

Further in accordance with a preferred embodiment of the present invention, the loader element, when in the retracted position, is adjacent to the inner ends of the loading bores, so as to permit insertion-of the pin stack elements into the bores; and when in the extended position, is adjacent to the outer ends of the loading bores, wherein movement of the loader element from the retracted position to the extended position is operative to cause ejection of the pin stack elements from the loading bores.

Additionally in accordance with a preferred embodiment of the present invention, the loader element has a linear contact surface for contacting the pin stack elements when inserted into the loading bores, and the loader includes hinge apparatus for maintaining the linear contact surface in an orientation parallel to the outer cylindrical surface of the shank, such that all of the pin stack elements are ejected from the loading bores at substantially the same rate.

Further in accordance with a preferred embodiment of the present invention, there is also provided a handle for selectably moving the loader element between the retracted and extended positions.

Additionally in accordance with a preferred embodiment of the present invention, the tool is adapted to receive in the set of loading bores a single plurality of pin stack elements for loading into the chambers, whereafter the shank is-inserted into the cylindrical bore of the shell, the set of loading bores is aligned with the set of chambers for ejection of the single plurality of pin stack elements from the set of bores into the set of chambers by operation of the loader element, after which the tool is removed from the cylindrical bore of the shell.

Further in accordance with a preferred embodiment of the present invention, the shank has a widened shoulder portion for limiting the depth of insertion of the shank into the cylindrical bore of the shell to a depth predetermined to facilitate registration of the set of bores with the set of chambers.

Additionally in accordance with a preferred embodiment of the present invention, the shank also has a guard groove formed along its length, parallel to the longitudinal axis and angularly spaced from the first, loading groove, the guard groove adapted to receive therein an elongate guard element when the tool is positioned within the cylindrical bore of the shell, thereby to lie across the open ends of the chambers and to ensure that the pin stack elements therein remain completely contained therein.

There is also provided, in accordance with a further embodiment of the invention, a kit for use in the loading of pin stack elements into a pin tumbler lock having a shell in which is formed a cylindrical bore adapted to receive a plug, the shell further having formed therein a set of chambers for containing a pin stack having one or more pin stack elements, wherein the kit includes a tool for loading a pin tumbler lock with one or more set of pin stack elements; and a loading guard for maintaining the loaded pin stack elements within the chambers when the cylindrical bore is not occupied by either the tool or the plug.

Preferably, the tool includes a cylindrical shank having a diameter similar to the diameter of the plug, and having formed therein a loading groove extending along at least a portion of the shank corresponding to the length of the set of chambers and intersecting with the longitudinal axis of the shank; a set of parallel loading bores formed in the shank, extending between the loading groove and the cylindrical outer surface of the shank, each loading bore dimensioned to contain one or more elements of a pin stack, the loading bores further having a spacing along the shank in a direction parallel to the longitudinal axis thereof equal to the spacing of the chambers; and a loader element mounted within the loading groove in adjustable positioning with respect to the loading bores, operative for selectable transfer of the one or more pin stack elements from each loading bore to a chamber in axial registration therewith.

Additionally in accordance with the present embodiment of the invention, the shank has a second, guard groove formed along its length, parallel to the longitudinal axis and angularly spaced from the first, loading groove, and wherein the loading guard includes:

an elongate guard element configured for insertion into the guard groove formed along the shank when the tool is positioned within the cylindrical bore of the shell, thereby to lie across the open ends of the chambers and to ensure that the pin stack elements therein remain completely contained therein; and apparatus for securing the guard element across the open ends of the chambers in the absence of the tool or the plug from the cylindrical bore.

Further in accordance with the present embodiment of the invention, the elongate guard element includes a generally rigid pin member, and the apparatus for securing includes resilient gripping apparatus connected to the pin member and fastened about the exterior of the shell.

BRIEF DESCRIPTION OF THE DRAWINGS

The present invention will be more fully understood and appreciated from the following detailed description taken in conjunction with the drawings, in which.

DETAILED DESCRIPTION OF THE PREFERRED EMBODIMENT

Referring now to FIGS. 2A-5C, in accordance with a preferred embodiment of the present invention, there is provided a lock maintenance kit which may be used either for completely reloading a cylinder, as described hereinbelow in conjunction with FIGS. 6-27, or for merely recoding a lock, as described hereinbelow in conjunction with FIGS. 23-27.

Figure 1A:
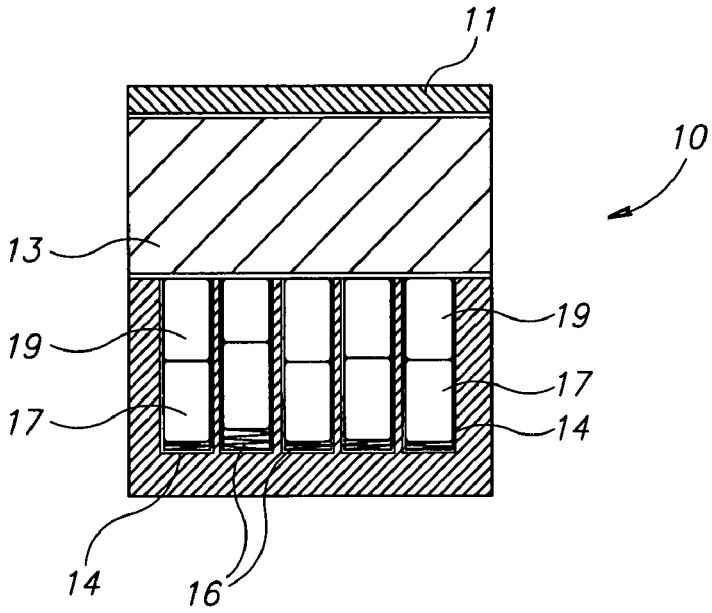
FIG. 1A is a cross-sectional view of a basic, fully assembled pin tumbler lock.
Figure 1B:
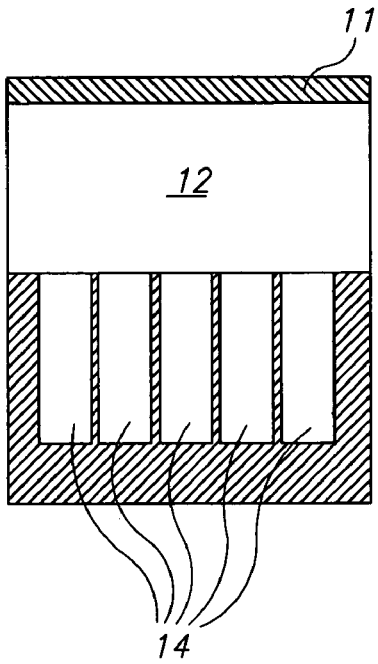
FIG. 1B is a cross-sectional view of the shell of the lock of FIG. 1A, ready for reloading.
Figure 3A:
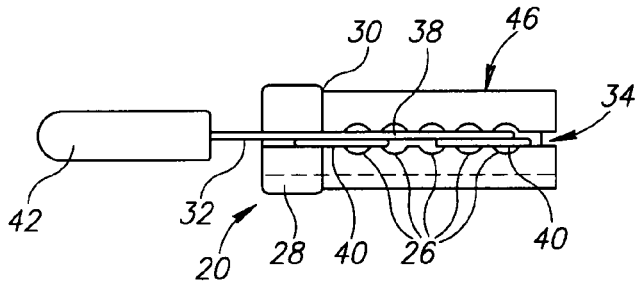
FIG. 3A is a top view of the lock tool of FIGS. 2A and 2B.
Figure 3B:
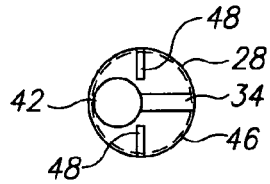
FIG. 3B is an end view of the tool as shown in FIG. 3A.
Figure 4A:
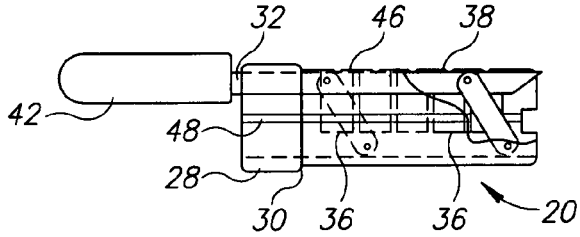
FIGS. 4A and 4B are a partially cut-away side view and an end view, respectively, of the lock tool of the present invention, seen in an upright position, and in a second operative position in which the loader element thereof is extended.
Figure 4B:
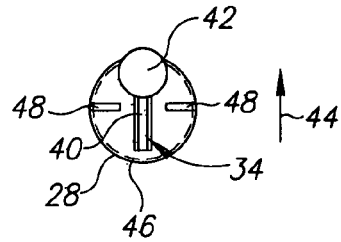
Figure 5A:
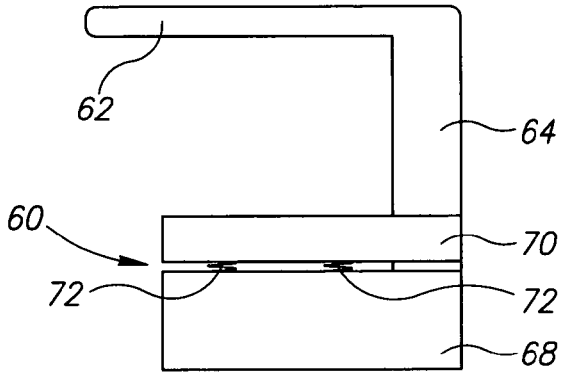
FIGS. 5A, 5B and 5C are side, bottom and end views, respectively, of a loading guard useful in conjunction with the lock tool of the kit of the present invention.
Figure 5B:
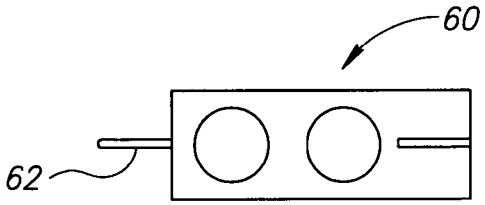
Figure 5C:
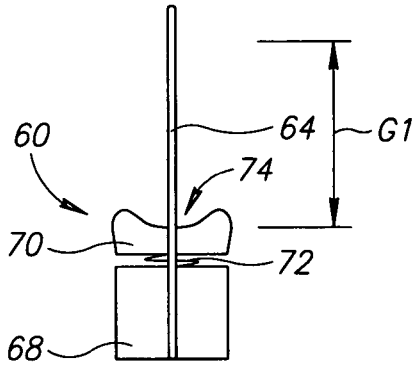

The kit includes a lock tool, referenced generally 20, depicted in FIGS. 2A-4B, and a loading guard 60, depicted in FIGS. 5A-5C. As will be appreciated from the description below, tool 20 is adapted to load the elements of the pin stack into the chambers 14 of shell 11 (FIG. 1B); and loading guard 60 is adapted to retain the loaded pin stack elements within chambers 14, between different loading stages, between the completion of the reloading of all of the pin stack elements, and insertion of the plug, and between removal of the plug and replacement of the key pins when recoding the lock.

Referring now initially to FIGS. 2A-4B, tool 20 is seen to have an elongate, cylindrical shank 22, having a working portion 24 in which is provided a set of mutually parallel loading bores 26, of a diameter which is similar to that of chambers 14 of shell 11 (FIG. 1B), so as to receive therein one or more pin stack elements, as described below. Bores 26 are formed radially, and have a spacing along the length of shank 22 equal to the spacing of chambers 14 (FIG. 1B) such that when working portion 24 is inserted into cylinder 12 (FIG. 1B), each of the bores 26 may be aligned in contiguous registration with a predetermined chamber 14, thereby to permit transfer thereto of pin stack elements from bores 26, as described hereinbelow.

Shank 22 preferably also has a collar portion, referenced 28, which is wider than cylinder 12 (FIG. 1B) and working portion 24 so as to define a shoulder 30, operative to limit the depth of entry of tool 20 into cylinder 12. This facilitates the manufacture of different lock tools 20 of different dimensions for predetermined pin tumbler locks whose shell, cylinder and chambers are of predetermined dimensions, such that insertion of tool 20 into cylinder 12 to the maximum possible depth, will always result in exact linear alignment of the loading bores 26 with chambers 14, once the tool 20 has been rotated so as to bring the loading bores 26 into angular alignment with chambers 14.

In order to permit the insertion of pin stack elements into bores 26, and subsequent ejection thereof from the bores 26 into chambers 14, there is provided an adjustably positionable loader element 32. Loader element 32 is seated within a loading groove 34 which extends diametrically across shank 22, so as to longitudinally split bores 26 into two symmetrical arcuate portions. This is seen in FIG. 3A. Loading groove 34 is further seen to have a depth which extends below the bottom ends 36 of bores 26, there remaining a sufficient thickness of material connecting the two longitudinally divided halves of shank 22 so as to impart structural integrity thereto.

Typically, all the components of tool 20 are formed of a suitable metal, although any other suitable material may also be used.

Figure 2A:
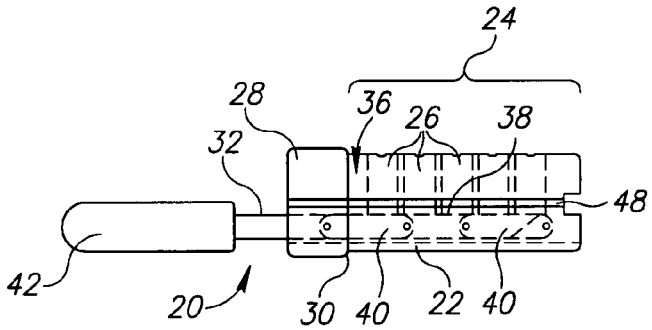
FIGS. 2A and 2B are side and end views, respectively, of the lock tool of the present invention, seen in an upright position, and in a first operative position in which the loader element thereof is retracted.
Figure 2B:
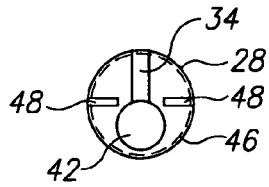

As seen in the drawings, loader element 32 preferably has a linear contact surface 38, and is supported by a pair of equally dimensioned hinges 40, so as to be movable, via a handle 42, from a retracted position, seen in FIG. 2A, to an extended position, seen in FIG. 4A.

In the retracted position, loader element 32 is seen to have a position such that contact surface 38 is located at or beneath the bottom ends 36 of bores 26, so as to permit loading of one or more pin stack elements thereinto. At this position, handle 42, which is shown, by way of example, to be attached in-line with loader element 32, is seen to have a corresponding position, opposite the bottom ends of bores 26.

A linear movement of handle 42, as indicated by arrow 44 in FIG. 4B, causes a corresponding, preferably parallel motion of loader element 32 to its extended position, as seen in FIG. 4A. As will be described hereinbelow, this movement of loader element 32 is operative to cause ejection from the bores 26 of the one or more pin stack elements supported on contact surface 38. In its extended position, the contact surface 38 of loader element 32 is brought to a position where it is substantially level with the cylindrical outer surface 46 of shank 22.

During use, once each bore 26 is arranged in collinear registration with a corresponding chamber 14, and each pin stack element has been loaded into chamber 14, contact surface 38 geometrically completes the continuum of cylindrical outer surface 46 of shank 22 adjacent to the openings of the chambers 14. In order to then remove shank 22 from cylinder 12, either so as to be able to load a further pin stack element or in order to reinsert the plug, shank 22 is rotated so as to bring one of the longitudinal guard grooves 48 formed on outer surface 46 of shank 22, into registration with chambers 14. Guard grooves 48 are sufficiently narrow so that they do not permit pin stack elements within chambers 14 to protrude therefrom.

The function of the one or more guard grooves 48 is to permit the positioning of loading guard 60 (FIGS. 5A-5C) so as to maintain the reloaded pin stack elements within chambers 14, and subsequent disengagement of the tool 20 from the shell I 1, as described hereinbelow.

Referring now to FIGS. 5A-5C, loading guard 60 includes an elongate guard element 62, illustrated as a rigid pin member, which is configured for insertion into a selected guard groove 48. Pin member 62 is fastened, as by an arm 64 to a base 68, having mounted thereon a gripping plate 70, fastened to base 68 by means of one or more compression elements 72. Gripping plate 70 preferably has a saddle shaped gripping surface 74, configured to seat the rounded end surface 111 (FIG. 1C) of shell 11 when in position.

Figure 1C:
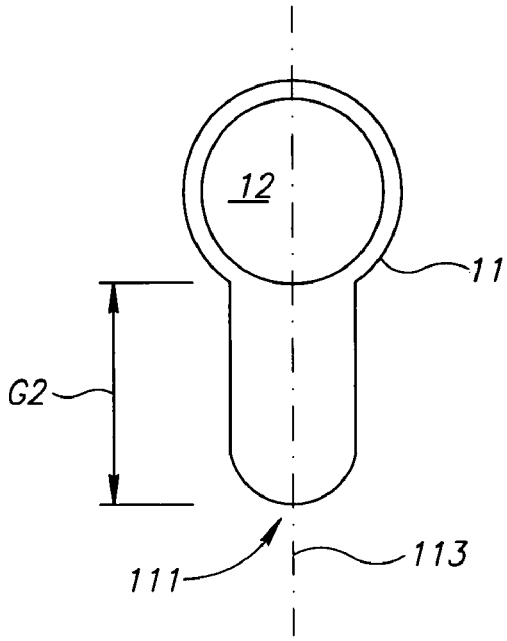
FIG. 1C is an end view of the shell depicted in FIG. 1B.

When in use, loading guard 60 is mounted onto shell 11 (FIGS. 1A-1C) so as to surround that portion thereof in which the chambers 14 are formed. Loading guard 60 is thus dimensioned such that once fastened to shell 11, the distance GI (FIG. 5C) between the gripping surface 74 and the closest portion of the pin member 62 is no greater than the distance G2 (FIG. 1C) between the inner surface of cylinder 12 and the rounded end surface 11 I(FIG. 1C) of shell 1, measured along the vertical axis of symmetry thereof, referenced 113 (FIG. 1C). This thus ensures that shell 11 is gripped properly by loading guard 60, and that the pin stack elements will not become inadvertently released.

It will thus be appreciated that upon insertion of pin member 62 into a guard groove 48, such as illustrated in FIGS. 12A, 12B, 19A and 19B, tool 20 can be completely disengaged from cylinder 12. Subsequent insertion of the lock tool 20 into cylinder 12 for loading of additional pin stack elements is then performed by positioning the shank 22 so that a guard groove 48 is aligned with the pin member 62. This enables full insertion of the tool 20 into cylinder 12, and loading of the additional pin stack elements, substantially as described hereinbelow.

Use of the kit of the invention is now described in conjunction with FIGS. 6-27. Throughout the ensuing description and drawings, the reference numerals used are those that are used in the description of FIGS. 1A-5C hereinabove. It will be appreciated however, that for purposes of clarity, only those portions of the drawings and the apparatus described in conjunction therewith, are necessarily denoted by reference numerals.

Referring initially to FIGS. 6-14B, there are shown various stages in the loading of first, compression spring elements 16 into a shell 11, as a first step in the reloading of a pin tumbler lock, by use of the lock tool 20 and loading guard 60, of the present invention.

Figure 6:
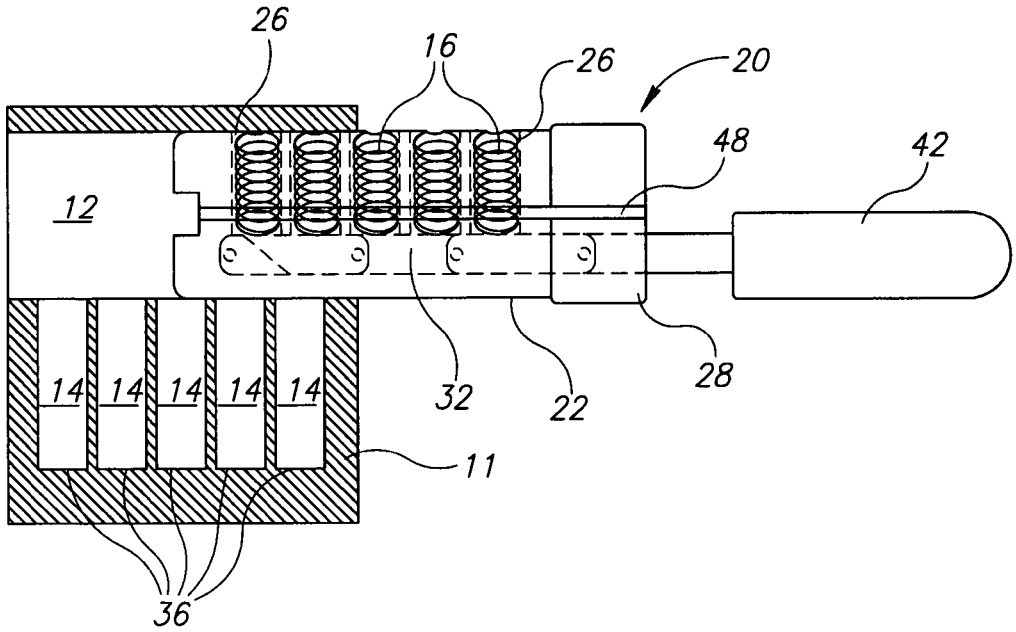
FIGS. 6-14B are various side-sectional and end views of a shell of a pin tumbler lock as seen in FIGS. 1A-1C, illustrating the insertion of compression springs into the shell, by use of the kit of the present invention.

Initially, as seen in FIG. 6, the loader element 32 is arranged in its retracted position, and spring elements 16 are inserted into loading bores 26, after which the shank 22 is inserted into cylindrical opening 12 of the shell 11.

Figure 7A:
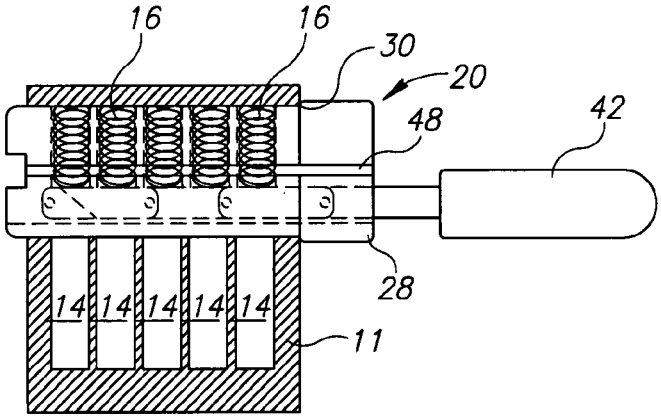
Figure 7B:
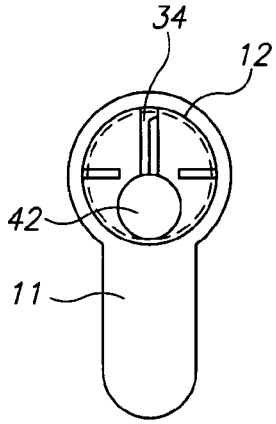

As seen in FIG. 7A, the shank 22 is inserted until shoulder 30 engages the exterior of shell 11. In accordance with a preferred embodiment of the invention, it is at this point that bores 26 are in collinear alignment with chambers 14 of shell 11. At this point, as seen also in FIG. 7B, bores 26 face away from chambers 14.

Figure 8A:
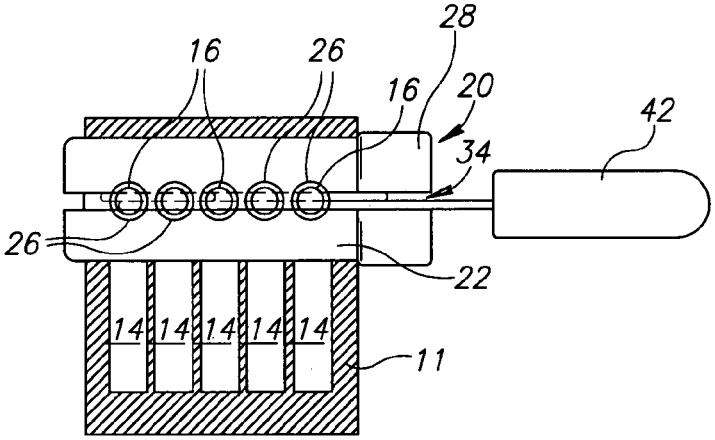
Figure 8B:
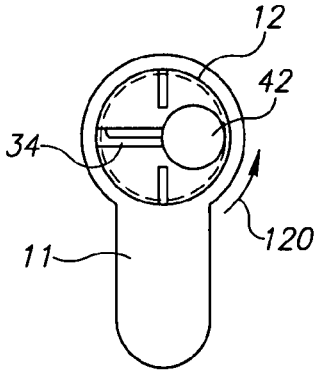
Figure 9A:
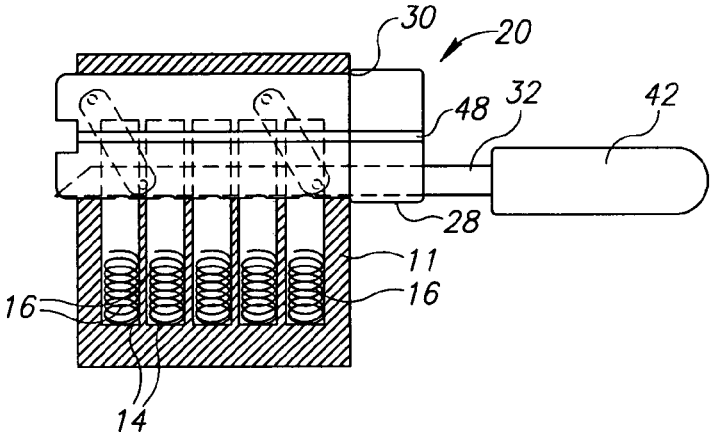
Figure 9B:
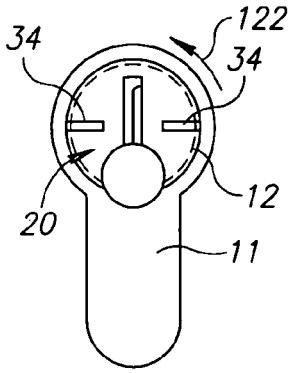
Figure 10A:
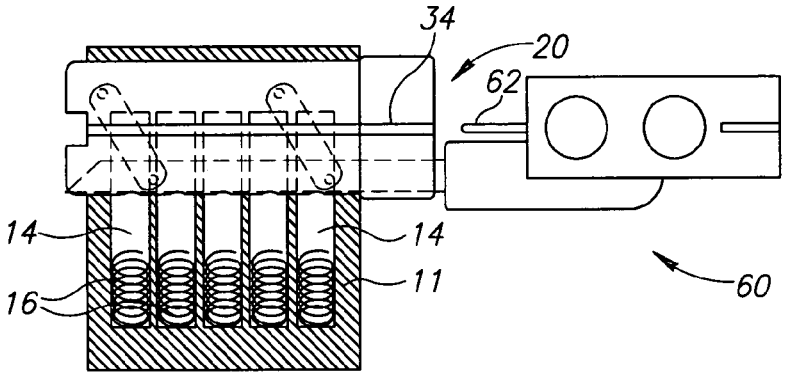
Figure 10B:
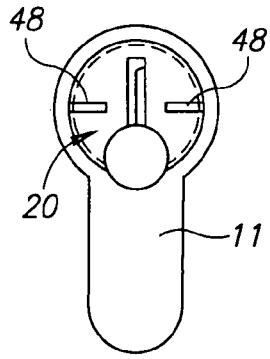
Figure 11A:
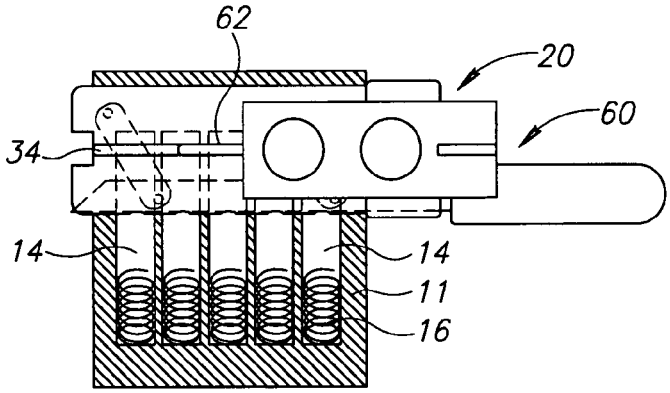
Figure 11B:
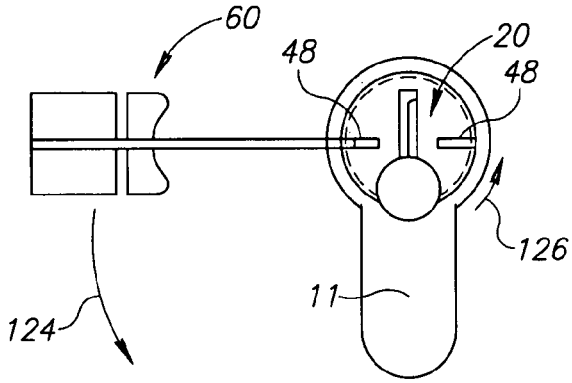
Figure 12A:
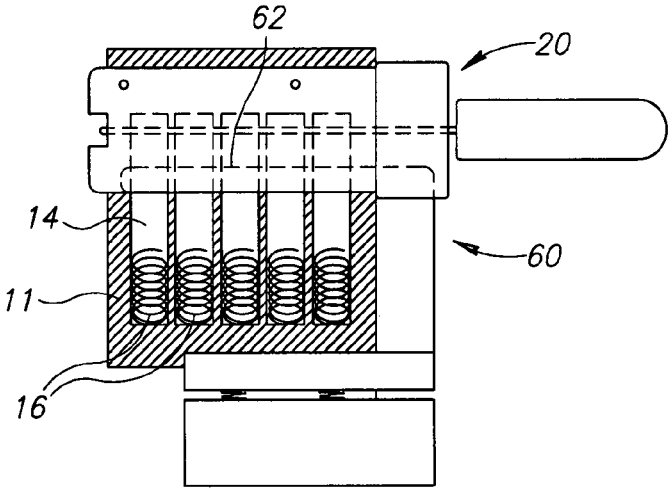
Figure 12B:
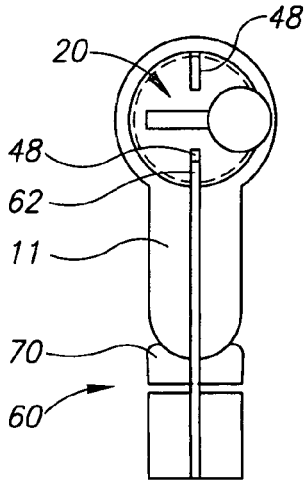

In order to load the spring elements 16 into chambers 14, tool 20 is rotated by handle 42, as shown by arrows 120 and 122 in FIGS. 8B and 9B respectively, such that the bores 26 and spring elements 16 contained therein, depicted in plan view in FIG. 8A, are brought into contiguous registration with chambers 14, as seen in FIG. 9A. Thereafter, handle 42 may be moved linearly so as to cause a similar movement of loader element 32, from its retracted position to its extended position, so as to eject spring elements 16 into chambers 14.

Figure 13:
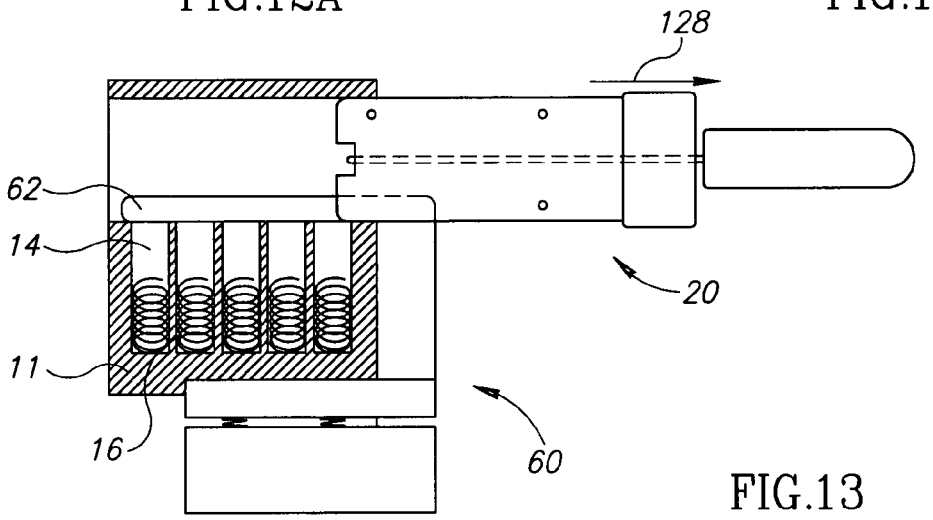
Figure 14A:
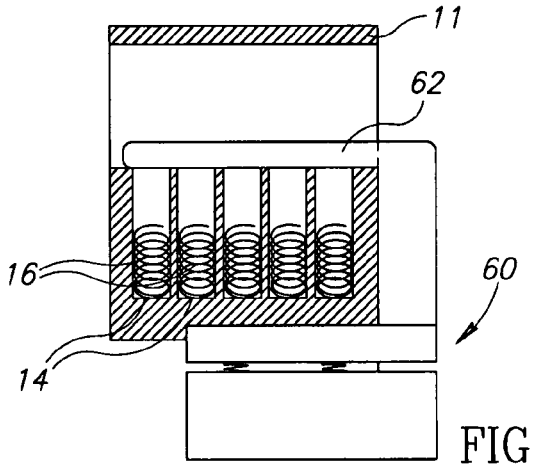
Figure 14B:
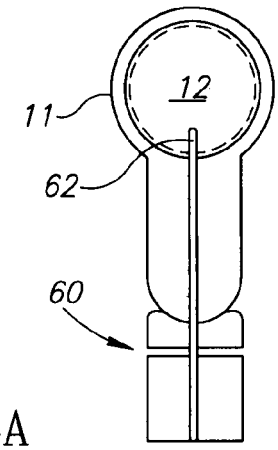

Referring now to FIGS. 10A-12B, pin member 62 of loading guard 60 is seen to be inserted into one of loading grooves 34 (FIGS. 10A-11B), and is subsequently rotated together with lock tool 20, as indicated by arrows 124 and 126 (FIGS. 11B), until loading groove 34 and thus bores 26 are transverse to chambers 14. In order to complete the rotation and thereby to secure guard element 62 across bores 26 as described above in conjunction with FIGS. 1A-5C, and into the position illustrated in FIGS. 12A and 12B, it is necessary to snap gripping plate 70 into engagement with rounded end surface 111 of shell 11. Thereafter, as seen in FIG. 13, tool 20 may be slidably withdrawn from shell 11 and guard element 62, as shown by arrow 128, such that loading guard 60 remains securely in place, retaining spring elements 16 within chambers 14, as shown in FIGS. 14A and 14B.

It will be appreciated that while shell 11 is illustrated in an 'upright' position, such that chambers 14 are oriented in a downward position such that even without the use of loading guard 60 the spring elements 16 would remain within chambers 14, the present invention is adapted for use in any desired orientation, and is not dependent on use in one or other predetermined orientation.

Referring now to FIGS. 15-21, lock tool 20 and loading guard 60 are shown in use during the loading of driver pin elements 17.

Figure 15:
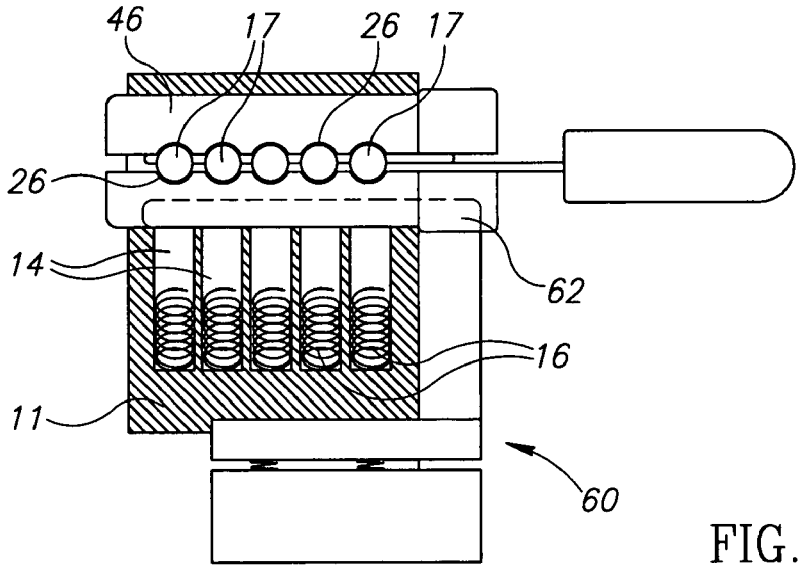
FIGS. 15-21 are various side-sectional and end views of a shell of a pin tumbler lock as seen in FIGS. 1A-1C, illustrating the insertion of driver pins into the shell, by use of the kit of the present invention.

Referring initially to FIG. 15, tool 20 is shown after receiving into bores 26 a plurality of driver pin elements 17. As loading guard 60 is fully engaged with shell 11, shank 22 is inserted into cylinder 12 after alignment of guard element 62 with one of guard grooves 48 (not shown) formed on outer surface 46 of shank 22, after which shank 22 may be slid therealong for insertion.

Subsequently, tool 20 and loading guard 60 are rotated such that the guard element 62 is moved out of alignment with chambers 14, but such that the bores 26 become fully obscured by the cylindrical outer surface 46 of shank 22, thereby to prevent release of spring elements 16 from chambers 14. At this point, loading guard 60 is no longer required and is removed.

Figure 16A:
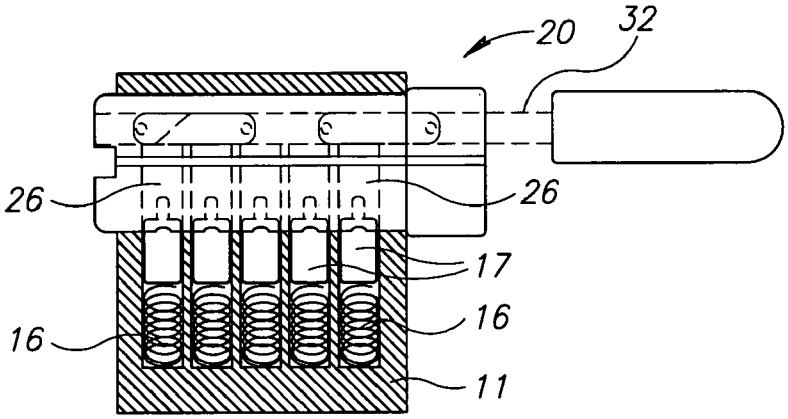
Figure 16B:
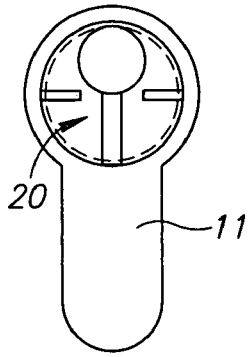
Figure 17A:
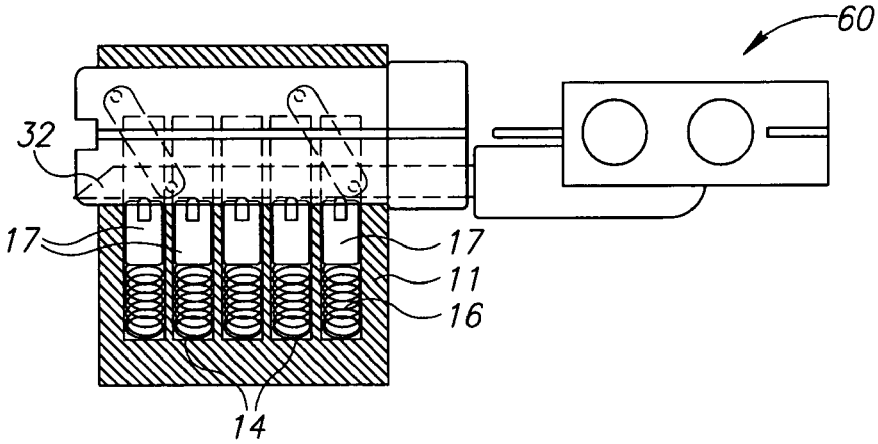
Figure 17B:
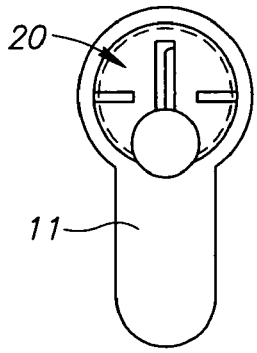
Figure 18A:
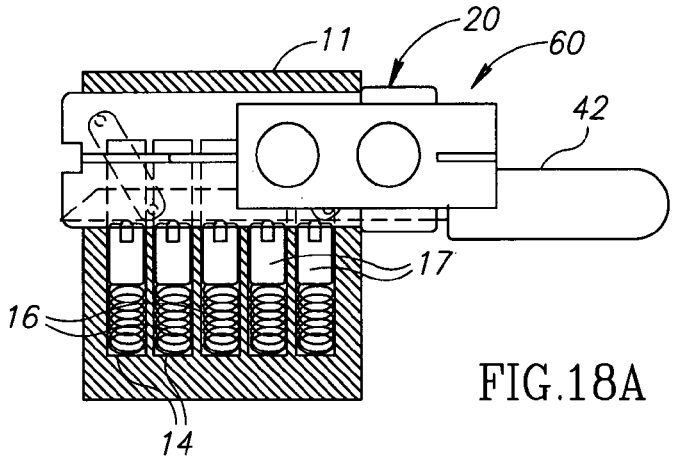
Figure 18B:
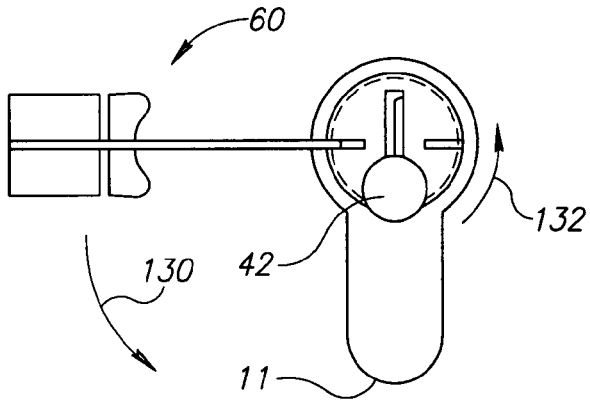
Figure 19A:
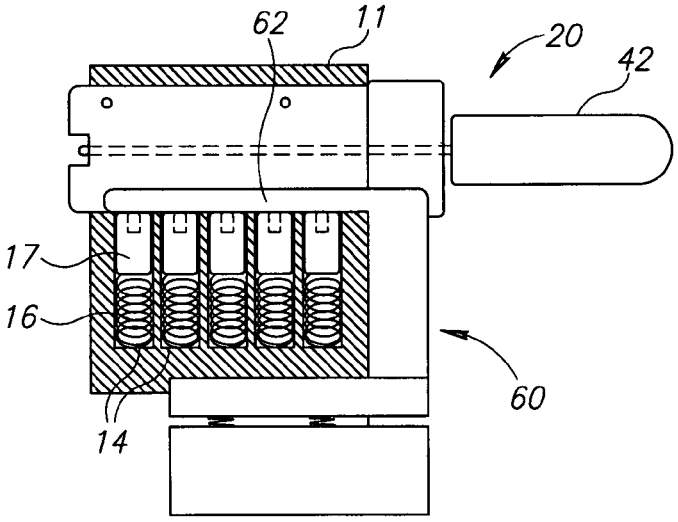
Figure 19B:
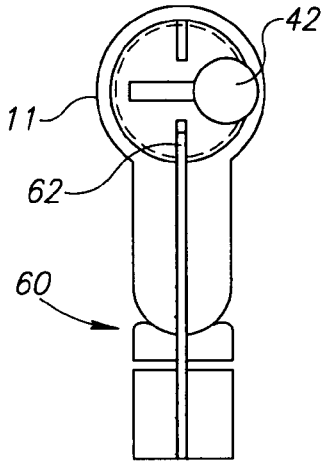
Figure 20:
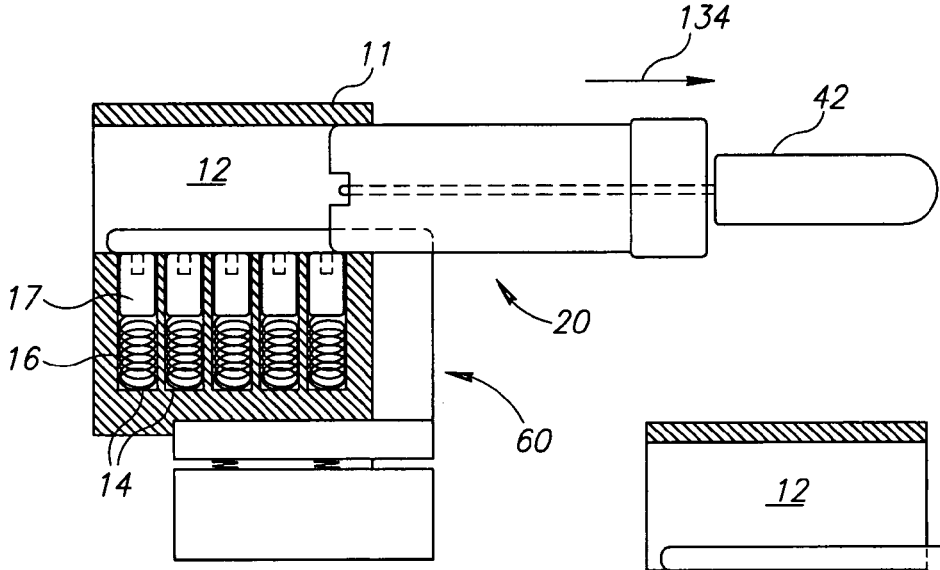
Figure 21:
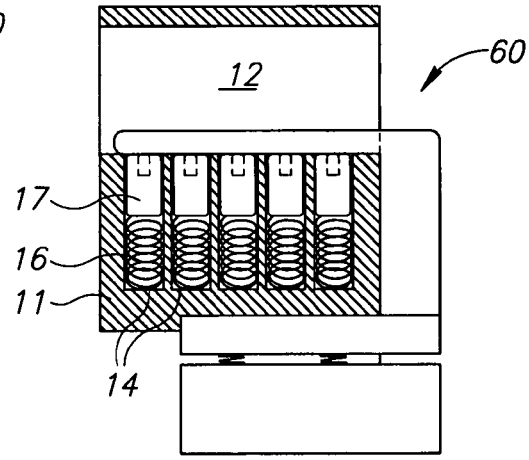

Subsequently, as seen in FIGS. 16A and 16B, tool 20 is rotated further so as to bring bores 26 into full contiguous registration with chambers 14, after which loader element 32 is extended, as seen in FIGS. 17A and 17B, so as to transfer driver pin elements 17 into chambers 14, thereby also partially compressing spring elements 16. Once loader element 32 has been fully extended, loading guard 60 is inserted again and, as seen in FIGS. 18A-19B, and indicated by arrows 130 and 132 (FIG. 18B), is rotated together with tool 20 so as to bring guard element 62 into alignment with bores 26 so as to retain spring elements 16 and driver pin elements 17 therewithin. Thereafter, as seen in FIG. 20, tool 20 may be slidably withdrawn from shell 11 and guard element 62, as shown by arrow 134, such that loading guard 60 remains securely in place, retaining spring elements 16 and driver pin elements 17 within chambers 14, as shown in FIG. 21.

Referring now to FIGS. 22-27, lock tool 20 and loading guard 60 are shown in use during the loading of third, key pin elements 19.

Figure 22:
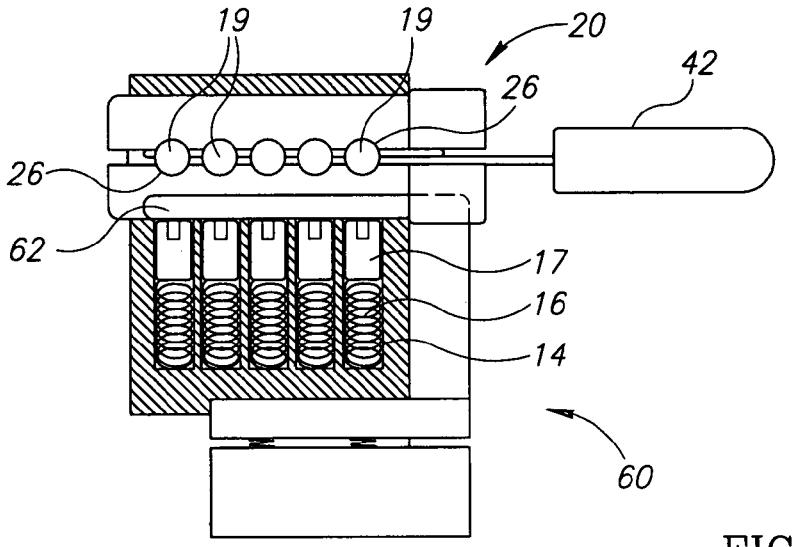
FIGS. 22-27 are various side-sectional views of a shell of a pin tumbler lock as seen in FIGS. 1A-1C, illustrating the insertion of key pins into the shell, by use of the kit of the present invention.

Referring initially to FIG. 22, tool 20 is shown after receiving into bores 26 a plurality of key pin elements 19. As loading guard 60 is fully engaged with shell 11, shank 22 is inserted into cylinder 12 after alignment with guard element 62 of one of guard grooves 48 (not shown) formed on outer surface 46 of shank 22, after which shank 22 may be slid therealong for insertion.

Subsequently, tool 20 and loading guard 60 are rotated such that the guard element 62 is moved out of alignment with chambers 14, but such that the bores 26 become fully obscured by the cylindrical outer surface 46 of shank 22, thereby to prevent release of spring elements 16 and driver pin elements 17 from chambers 14. At this point, loading guard 60 is no longer required and is removed.

Figure 23:
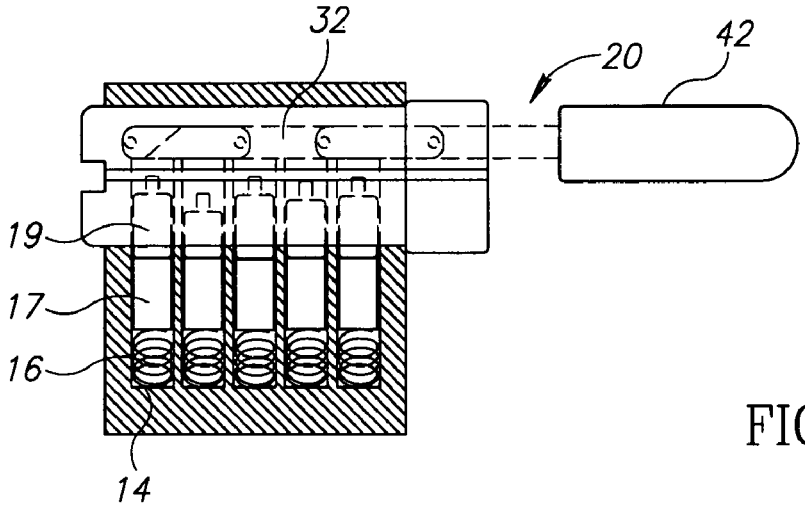
Figure 24:
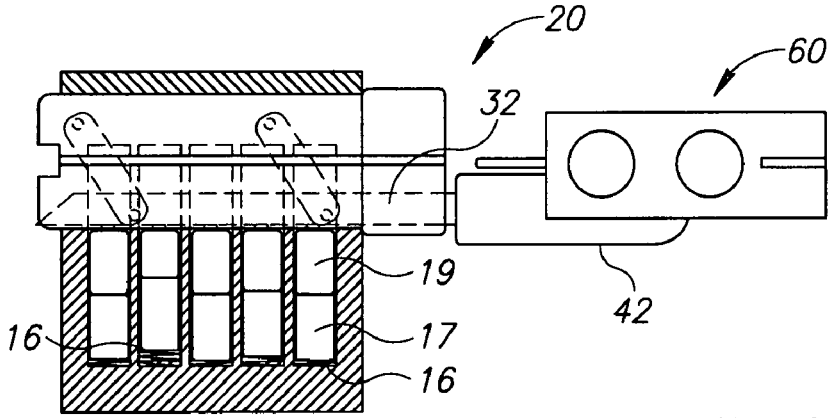
Figure 25:
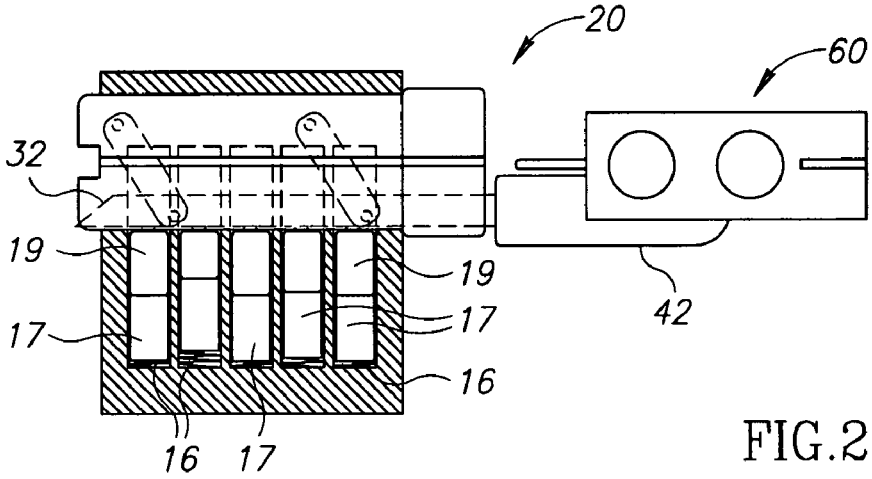
Figure 26:
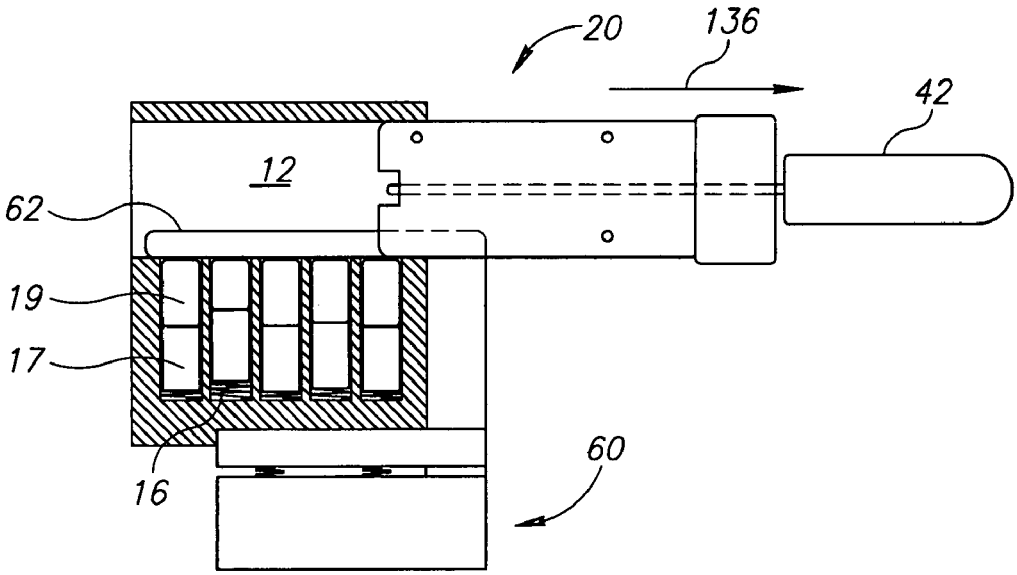
Figure 27:
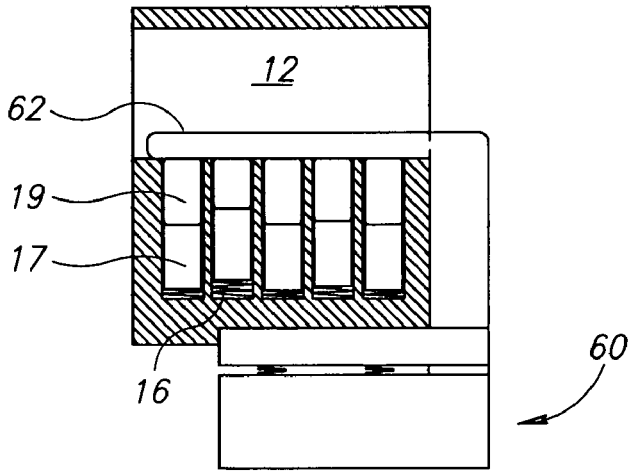

Subsequently, tool 20 is rotated further so as to bring bores 26 into full contiguous registration with chambers 14 as seen in FIG. 23, after which loader element 32 is extended, as seen in FIG. 24, so as to transfer key pin elements 19 into chambers 14, thereby forcing driver pin elements 17 further into chambers 14, and thus further compressing spring elements 16. Once loader element 32 has been fully extended, loading guard 60 is inserted again as seen in FIG. 25, is rotated together with tool 20 so as to bring guard element 62 into alignment with chambers 14 so as to retain spring elements 16, driver pin elements 17, and key pin elements 19 therewithin. Thereafter, as seen in FIG. 26, tool 20 may be slidably withdrawn from shell 11 and guard element 62, as shown by arrow 136, such that loading guard 60 remains securely in place, retaining the entire set of pin stacks within chambers 14, as shown in FIG. 27.

It will be appreciated by persons skilled in the art that in view of the simplicity and ease of use of the kit of the present invention, it may also be used to recode a lock. In accordance with the present invention, after removal of the plug and subsequent removal of the pins, (the springs do need necessarily need to be removed) prior to replacement of the key pins, differently sized key pins or a different arrangement of the original key is selected, thereby recoding the lock.

It will be appreciated by persons skilled in the art that the scope of the present invention is not limited by what has been shown and described hereinabove, merely by way of example. Rather, the scope of the invention is limited solely by the claims, which follow.

The invention claimed is:

1. A tool for loading one or more pin stack elements into a pin tumbler lock having a shell in which is formed a cylindrical bore adapted to receive a plug, the shell further having formed therein a set of chambers for containing a pin stack having one or more pin stack elements, wherein said tool comprises:

a cylindrical shank having a diameter similar to the diameter of the plug, and having formed therein a loading groove extending along at least a portion of said shank corresponding to the length of the set of chambers and intersecting with the longitudinal axis of said shank; wherein said loading groove has a width whose magnitude is less than the diameter of each said loading bore, said loading groove intersecting with said loading bores along their entire depth;

a set of parallel loading bores formed in said shank, extending between said loading groove and the cylindrical outer surface of said shank, each said loading bore dimensioned to contain at least one element of a pin stack, said loading bores further having a spacing along said shank in a direction parallel to said longitudinal axis thereof equal to the spacing of the chambers; and a hinged loader element, having a contact surface, mounted within said loading groove in adjustable positioning between a retracted position and an extended position with respect to said loading bores, operative for selectable transfer of a pin stack element from each said loading bore to a chamber in axial registration therewith, wherein when said loader element is in the extended position its contact surface is substantially level with said cylindrical outer surface of said shank; wherein said loader element is attached to said shank by a pair of equally dimensioned hinges.

2. A tool according to claim 1, wherein each said loading bore has an inner end formed within said shank, and an outer end at which is defined an opening at the outer cylindrical surface of said shank through which the pin stack element is inserted prior to insertion of said shank into said cylindrical bore of said shell.

3. A tool according to claim 2, wherein said loader element, when in said retracted position, is adjacent to said inner ends of said loading bores, so as to permit insertion of the pin stack elements into said bores; and when in said extended position, is adjacent to said outer ends of said loading bores, wherein movement of said loader element from said retracted position to said extended position is operative to cause ejection of the pin stack elements from said loading bores.

4. A tool according to claim 3, wherein said loader element has a linear contact surface for contacting the pin stack elements when inserted into said loading bores, and said pair of equally dimensioned hinges maintains said linear contact surface in an orientation parallel to said outer cylindrical surface of said shank, such that all of the pin stack elements are ejected from said loading bores at substantially the same rate.

5. A tool according to claim 4, and also including a handle for selectably moving said loader element between said retracted and extended positions, wherein a relatively linear movement of said handle causes a parallel motion moving said loader element from said retracted position to said extended position resulting in ejection of the pin stack elements from said loading bores to said chamber in axial registration therewith.

6. A tool according to claim 1, and wherein said tool is adapted to receive in said set of loading bores a single plurality of pin stack elements for loading into the chambers, whereafter said shank is inserted into the cylindrical bore of the shell, said set of loading bores is aligned with the set of chambers for ejection of the single plurality of pin stack elements from said set of bores into the set of chambers by operation of said loader element, after which said tool is removed from the cylindrical bore of the shell.

7. A tool according to claim 1, wherein said shank has a widened shoulder portion for limiting the depth of insertion of said shank into the cylindrical bore of the shell to a depth predetermined to facilitate registration of said set of bores with the set of chambers.

8. A tool according to claim 1, wherein said shank also has a guard groove formed along its length, parallel to said longitudinal axis and angularly spaced from said first, loading groove, said guard groove adapted to receive therein an elongate guard element when said tool is positioned within the cylindrical bore of the shell, thereby to lie across the open ends of the chambers and to ensure that the pin stack elements therein remain completely contained therein.

9. A kit for use in the loading of pin stack elements into a pin tumbler lock having a shell in which is formed a cylindrical bore adapted to receive a plug, the shell further having formed therein a set of chambers for containing a pin stack having one or more pin stack elements, wherein said kit includes:

a tool for loading a pin tumbler lock with at least one set of pin stack elements; and a loading guard for maintaining the loaded pin stack elements within the chambers when the cylindrical bore is not occupied by either said tool or the plug; and wherein said tool comprises:

a cylindrical shank having a diameter similar to the diameter of the plug, and having formed therein a loading groove extending along at least a portion of said shank corresponding to the length of the set of chambers and intersecting with the longitudinal axis of said shank;

a set of parallel loading bores formed in said shank, extending between said loading groove and the cylindrical outer surface of said shank, each said loading bore dimensioned to contain at least one element of a pin stack, said loading bores further having a spacing along said shank in a direction parallel to said longitudinal axis thereof equal to the spacing of the chambers; and a hinged loader element, having a contact surface, mounted within said loading groove in adjustable positioning between a retracted position and an extended position with respect to said loading bores, operative for selectable transfer of the at least one pin stack element from each said loading bore to a chamber in axial registration therewith, wherein when said loader element is in the extended position its contact surface is substantially level with said cylindrical outer surface of said shank.

10. A kit according to claim 9, wherein said loading groove has a width whose magnitude is less than the diameter of each said loading bore, said loading groove intersecting with said loading bores along their entire depth.

11. A kit according to claim 10, wherein said loader element is attached to said shank by a pair of equally dimensioned hinges.

12. A kit according to claim 11, wherein each said loading bore has an inner end formed within said shank, and an outer end at which is defined an opening at the outer cylindrical surface of said shank through which the pin stack element is inserted prior to insertion of said shank into said cylindrical bore of the shell.

13. A kit according to claim 12, wherein said loader element, when in said retracted position, is adjacent to said inner ends of said loading bores, so as to permit insertion of a pin stack element into each of said bores; and when in said extended position, is adjacent to said outer ends of said loading bores, wherein movement of said loader element from said retracted position to said extended position is operative to cause ejection from said loading bores of the pin stack elements contained therein.

14. A kit according to claim 13, wherein said loader element has a linear contact surface for contacting the pin stack elements when inserted into said loading bores, and said pair of equally dimensioned hinges maintains said linear contact surface in an orientation parallel to said outer cylindrical surface of said shank, such that all of the pin stack elements are ejected from said loading bores at substantially the same rate.

15. A kit according to claim 14, and also including a handle for selectably moving said loader element between said retracted and extended positions, wherein a relatively linear movement of said handle causes a parallel motion moving said loader element from said retracted position to said extended position resulting in ejection of the pin stack elements from said loading bores to said chamber in axial registration therewith.

16. A kit according to claim 9, wherein said shank has a widened shoulder portion for limiting the depth of insertion of said shank into the cylindrical bore of the shell to a depth predetermined to facilitate registration of said set of bores with the set of chambers.

17. A kit according to claim 9, wherein said shank has a second, guard groove formed along its length, parallel to said longitudinal axis and angularly spaced from said first, loading groove, and wherein said loading guard comprises:

an elongate guard element configured for insertion into said guard groove formed along said shank when said tool is positioned within the cylindrical bore of the shell, thereby to lie across the open ends of the chambers and to ensure that the pin stack elements therein remain completely contained therein; and means for securing said guard element across the open ends of the chambers in the absence of said tool or the plug from the cylindrical bore.

18. A kit according to claim 17, wherein said elongate guard element comprises a generally rigid pin member, and said means for securing comprises resilient gripping means connected to said pin member and fastened about the exterior of the shell.

* * * * *